United States Patent [19]

Bostick et al.

[11] Patent Number: 5,074,272

[45] Date of Patent: Dec. 24, 1991

[54] PROCESS AND APPARATUS FOR REDUCING PORT FUEL INJECTOR DEPOSITS

[75] Inventors: Giles L. Bostick, Ashland; Carlton H. Jewitt, Catlettsburg; Victor L. Kersey, Ashland, all of Ky.

[73] Assignee: Ashland Oil, Inc., Ashland, Ky.

[21] Appl. No.: 449,460

[22] Filed: Dec. 7, 1989

Related U.S. Application Data

[63] Continuation of Ser. No. 186,325, Apr. 26, 1988, abandoned, which is a continuation of Ser. No. 896,168, Aug. 13, 1986, abandoned.

[51] Int. Cl.[5] ..... F02M 39/00

[52] U.S. Cl. ..... 123/514; 123/467; 123/516

[58] Field of Search ..... 123/516, 514, 510, 511, 123/458, 467, 452–455

[56] References Cited

U.S. PATENT DOCUMENTS

| | | | |
|---|---|---|---|
| 4,530,329 | 7/1985 | Maisch | 123/516 |
| 4,562,816 | 1/1986 | Dörr | 123/456 |
| 4,782,808 | 11/1988 | Bostick | 123/514 |

FOREIGN PATENT DOCUMENTS

| | | | |
|---|---|---|---|
| 2918399 | 11/1980 | Fed. Rep. of Germany . | |
| 0200663 | 12/1982 | Japan | 123/516 |
| 0048768 | 3/1983 | Japan | 123/516 |

*Primary Examiner*—Carl Stuart Miller

*Attorney, Agent, or Firm*—Richard C. Willson, Jr.

[57] ABSTRACT

Plugging of fuel injectors for internal combustion engines is reduced by depressurizing the fuel pressure line which feeds the injectors, promptly after shutoff of ignition. Reduction of deposits assists in maintaining drivability and fuel economy.

10 Claims, 4 Drawing Sheets

PROCESS AND APPARATUS FOR REDUCING PORT FUEL INJECTOR DEPOSITS

This case is a file wrapper continuation of Ser. No. 07/186,325, filed Apr. 26, 1988 and now abandoned, which is, in turn, a continuation of Ser. No.: 06/896,168, filed Aug. 13, 1986, now also abandoned.

BACKGROUND OF THE INVENTION

To provide better drivability and performance while maintaining fuel economy requirements, automotive designers have shifted rapidly away from carburation to injection of fuel. Especially attractive is port fuel injection (PFI, also called "multi port fuel injection") in which injectors discharge fuel into an intake runner or intake port, which delivers air to the combustion chamber or cylinder of the engine.

For accurate, precise, injection of fuel into each combustion chamber or cylinder, the injector is best located as close as possible to the intake valve. This requires the injector to operate in an environment of relatively high temperature, particularly during "hot soak", when the engine ignition system has been turned off, stopping the circulation of coolant through the engine, but leaving the hot cylinders to transfer their heat to the injector and other outer parts of the engine.

Under these conditions, the injector temperatures can reach or exceed 90° C. (194° F.) and carbon and varnish deposits can form on the injector internal parts, particularly the injector tip. Because of the high precision of injector parts, these deposits can restrict fuel flow. This problem, which has recently become widespread, is commonly termed "port injector plugging" and can markedly impair drivability, causing hesitation, poor fuel economy, increased exhaust emissions, and excessive stalling.

(1) Field of the Invention

The present invention relates to fuel injection systems, generally classified in Class 123, variously in subclasses 32, 139, 119, 478, 494, 436, 478, and 536-539.

(2) Description of the Prior Art

Conventional fuel injection systems are generally described in U.S. patents in Class 123, including U.S. Pat. No. 4,539,961 assigned General Motors, which shows the fuel rail port fuel injectors for delivering fuel to an engine and shows pressure regulator valve 50 for maintaining the pressure in fuel rail 22 relatively constant during engine operation.

Control systems for fuel injection are discussed in a number of patents in Class 123, including U.S. Pat. No. 4,501,249 assigned to Hitachi, which details a control apparatus for controlling the amount and timing of fuel injection with the aid of a microcomputer reading inputs from a hot-wire type flow sensor for detecting air flow velocity within an intake air passage of an internal combustion engine.

U.S. Pat. No. 4,347,825 assigned Nissan electrifies fuel to atomize it into fine fuel particles and avoid attachment onto the surrounding wall of the air intake.

A diagram of a conventional fuel injector is shown in FIG. 2 of U.S. Pat. No. 4,020,802 assigned Nipon Soken. This figure shows the injector assembly for (a) near the intake valve 20(*a*), and discharging directly into the intake port 19(*a*), through which air flows through the valve into the combustion chamber.

To address the problem of avoiding port fuel deposits, a number of solutions have been tried including gasoline additives e.g. those manufactured by DuPont and Lubrizol Corporations, Ethyl, Nalco, Chevron, Mobil, Amoco Chemical, Exxon, etc.

Rochester Division of General Motors Corporation's, Multec Injector System, shows a method for providing a multiplicity of fuel-spray cones into the intake port. Allied Automotive, formerly Bendix Corporation, has recently introduced their "Deka" injector, providing similar multi-spray cones of fuel injected into the intake port. Both of these injector configurations are designed to avoid, to some extent, the susceptibility to plugging of the injector.

Rather than requiring additives to be inserted into all of the fuel to be burned by an engine, or requiring redesign of the individual injectors, the present invention provides a change in system conditions which has been found to substantially reduce deposits with relatively minor modification of the fuel system components. The simplicity of the present invention also permits it to be readily inserted into the millions of fuel-injected internal combustion engines which have already been manufactured.

SUMMARY (1) General Statement of the Invention

The present invention utilizes the discovery that, if the pressure of the fuel rail (the manifold which feeds the port fuel injectors) is reduced upon ignition cutoff, deposits on the port fuel injectors can be sharply reduced. The invention can accomplish its advantageous purpose by any means of reducing the pressure upstream from the port fuel injectors e.g. by venting the fuel pressure line into the lower pressure return line, or back into the fuel tank by bypassing the tank-mounted fuel pump. This can be accomplished by various bypasses or shunts which open at the time of ignition cutoff e.g. by normally open valves which are held closed by electromagnet during engine operation and which open upon ignition cutoff to vent pressure from the fuel pressure line. The pressure is preferably reduced within 5 minutes, more preferably within 30 seconds and most preferably within 10 seconds of ignition shut-off.

A particularly simple and economic way of accomplishing this reduction in pressure is by modification of the fuel system pressure regulator e.g. that shown as Element 50 in FIG. 3 of U.S. Pat. No. 4,539,961, or as Element 27 of U.S. Pat. No. 4,347,825, or as Element 40 of FIG. 1 of the present application, so that the pressure regulator opens or bypasses in response to vacuum, electromagnet or other actuator responsive to ignition shut-off. The fuel line pressure is preferably reduced to less than about 10 kPa, more preferably less than about 5 kPa, and most preferably less than 1 kPa.

(2) Utility of the Invention

The present invention, by reducing deposits on port fuel injectors avoids or alleviates the aforementioned problems of poor fuel economy, impaired drivability, increased exhaust emissions, and hesitation and excessive stalling.

While the invention is particularly preferred for piston-type internal combustion engines, especially those used on vehicles, it can in some circumstances be employed in other engines which impose high temperature environments upon their injectors, e.g. rotary engines, such as the Wankel, turbine engines, etc.

DESCRIPTION OF THE PREFERRED EMBODIMENTS

Figure 1:
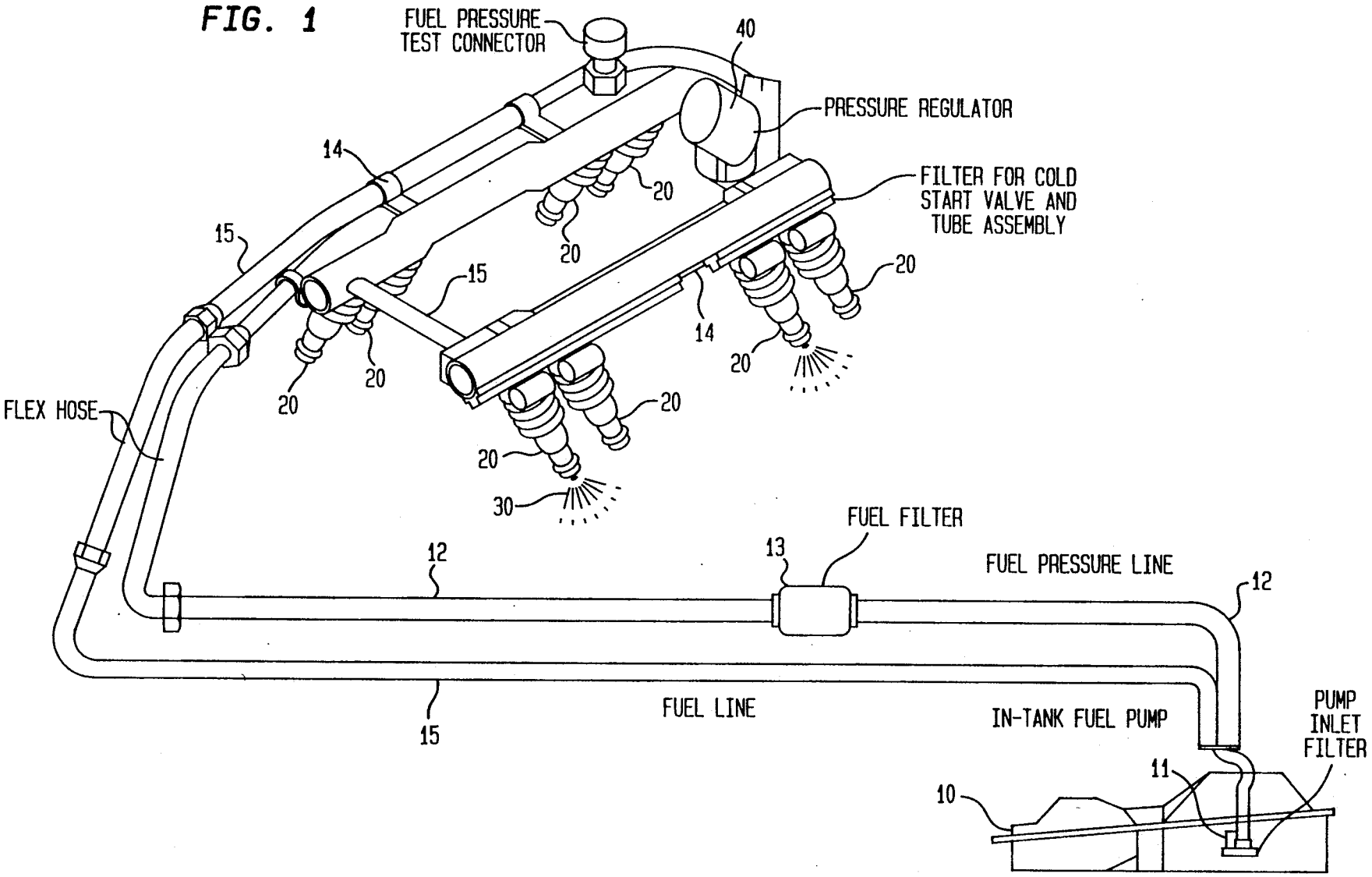
FIG. 1 is a schematic diagram of the fuel system for a conventional, modern port fuel injection system.

FIG. 1 shows a typical port-fuel injection fuel delivery system.

In FIG. 1, automotive fuel tank 10 contains in-tank fuel pump 11, which is attached to fuel pressure line 12, which is interrupted by fuel filter 13 and then continues on through flexible hoses to two fuel rails 14, connected together by cross-manifold 15. Each fuel rail 14 is connected to four fuel injector assemblies 20. (This engine is a V-8, an inline four cylinder engine would have only one rail, much as shown in U.S. Pat. No. 4,539,961, which shows rail 22 connected to four injectors 36. A V-6 fuel system would be similar to FIG. 1 of the present application, but would have three injectors on each fuel rail).

Each injector assembly sprays a spray-cone 30 of fuel into the intake port 19 from which the fuel-air mixture flows past valve 31 into combustion chamber 32 for ignition by spark plug 33, forcing piston 34 downward. During engine operation, coolant circulates through coolant jacket 35 maintaining the engine block 36 at temperatures in the range of about 92° to 114° C. (200° to 240° F.).

Figure 4:
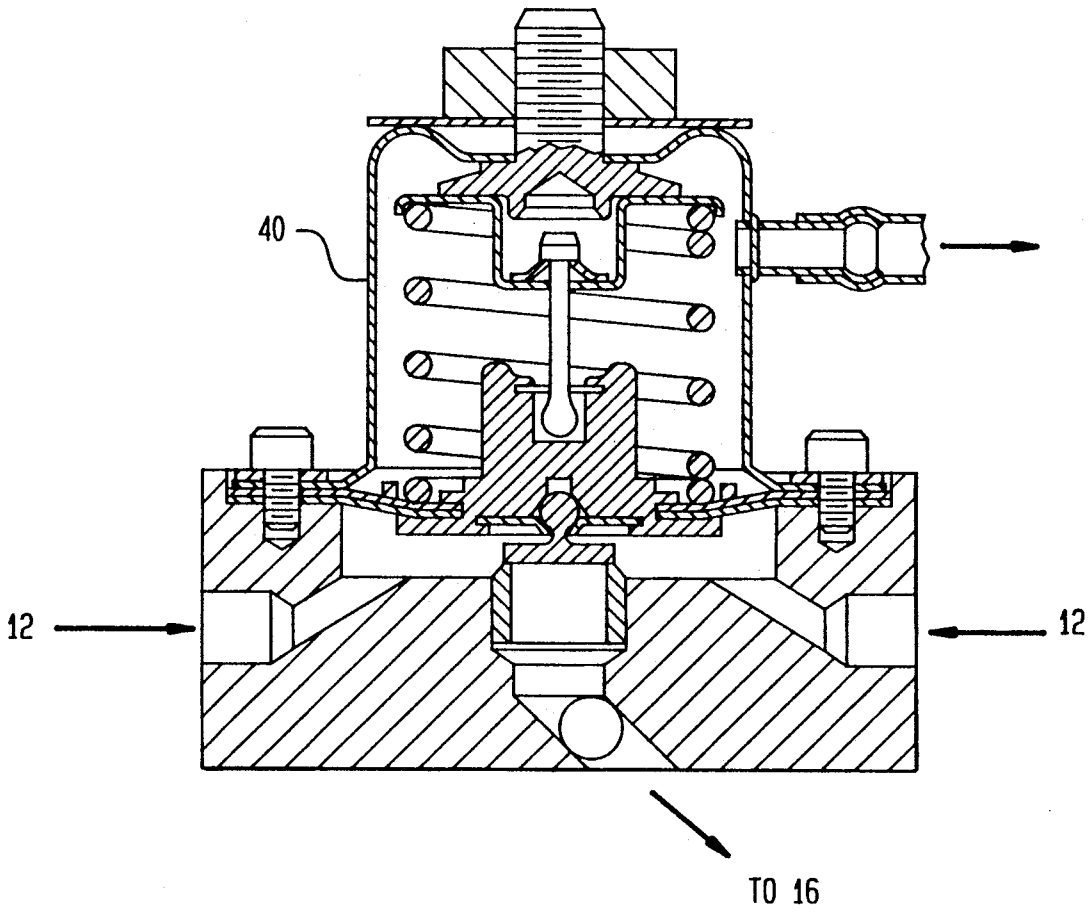
FIG. 4 is a schematic drawing showing a typical fuel pressure regulator, along the lines of U.S. Pat. No. 4,539,961 with the internal parts of the pressure regulator believed to be approximately identical with those being used on automobiles produced today.
Figure 5:
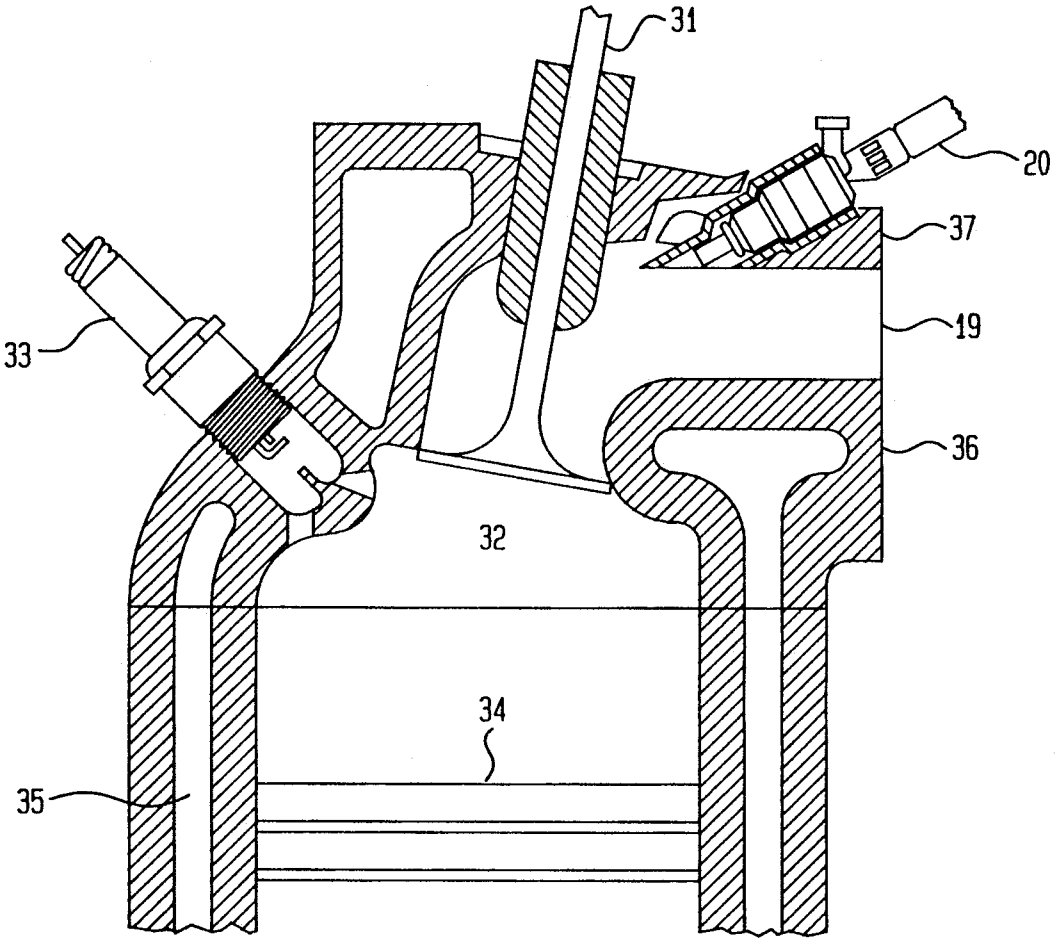
FIG. 5 is a cross sectional view of a typical engine showing the injector communicating with the fuel intake port.

At its downstream end, fuel pressure line 12 communicates with pressure regulator 40 (shown in detail in FIG. 4). Pressure regulator 40 discharges into fuel return line 16, which returns fuel to fuel tank 10. The pressure drop across pressure regulator 40 determines the pressure to be maintained in fuel pressure line 12, which feeds the injectors 20. This pressure is generally maintained in the range about 69 to 691 kilopascals (kPa) (10 to 100 pounds per square inch gauge, psig). More preferably 172 to 519 kilopascals (25 to 75 pounds per square inch gauge), and most preferably 275 to 325 kPa (40 to 47 psig) during operation of the engine.

Upon ignition shut-off in a conventional port fuel injected engine, the pressure in fuel line 12 remains near the above operating pressure for a substantial period of time, often more than one hour. Pressure will generally be relieved by leakage through the injectors into the cylinders.

A second phenomenon also occurs during engine shut-off; the coolant flow through jacket 35 is discontinued and the temperature of the engine wall 36 rises, often dramatically, to temperatures as high as 90° to 110° C. (194° to 230° F.).

This combination of pressure leakage forcing fuel into the pintle area of the injector, and the heating of this pintle area of the injector by contact with the hot intake manifold 37, increasing the pintle temperature to the range of 90° to 110° C. (194° to 230° F.) appears to cause the harmful deposits.

EXAMPLES A–D

Conventional Fuel Pressure Line, Remaining Pressurized After Ignition Shut-off In the following, each cycle is equivalent to approximately 13 miles on a chassis dynamometer to simulate driving conditions by accelerating to 55 miles per hour; maintaining that speed for 15 minutes to provide good engine warm up; deaccelerating to stop and ignition cut-off; followed by a 45 minute period of heat soak to build up temperature on the injector components. One can unload the pressure by various means, e.g. by electromagnetic means installed in the FIG. 4 pressure regulator, and by a bypass between lines 12 and 16 in FIG. 1.

When a V-8 engine having a fuel system as described above, is tested as set forth in Table I for from 185 to 175 test cycles, and the flow through each of the injectors 1–8 is measured after each series of test cycles A–D, the average flow reduction is from 8.8 to 13%. This average flow reduction is itself sufficient to produce noticeable impairment of drivability and fuel economy. However, the effect is compounded by the severe flow restriction ("port injector plugging") experienced in certain injectors e.g. the 43% in injector 8 in Example C and the 22% in injector 4 in Example A, and the 21% reduction in injector 2 of Example D, and the 19% reduction in injector 7 of Example D, and the 27% reduction in injector 8 of Example D. These individual cylinder reductions can cause severe missing.

Figure 3:
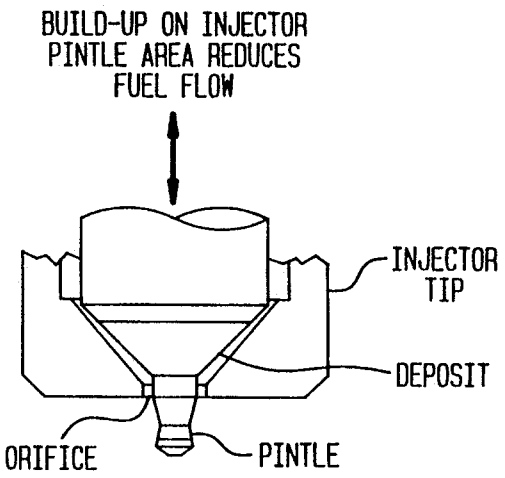
FIG. 3 is a detail of the cross sectional view of FIG. 2, showing schematically the injector tip, the pintle, and orifice, which are the particularly close tolerance components and showing schematically some deposits forming on the main surface of the injector tip.
Figure 2:
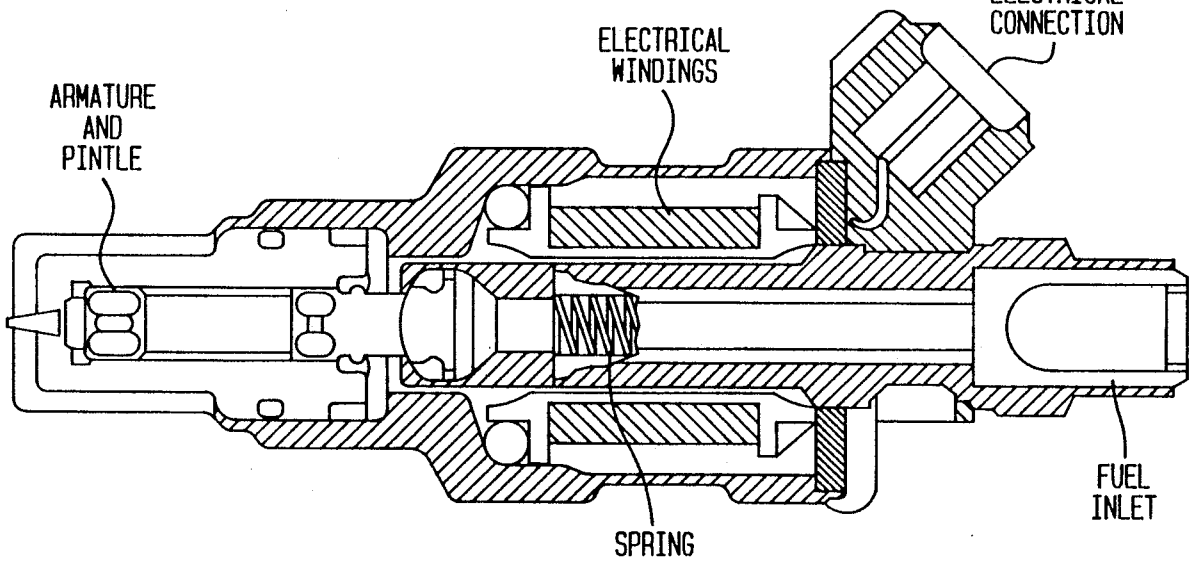
FIG. 2 is a cross sectional view of a typical fuel injector similar to that manufactured by Bosch of West Germany.

On examination of the plugged port fuel injectors, it is found that the injector tip has deposits as shown in FIG. 3. These deposits are amber, varnish-like, and while they are minute in weight, they effectively restrict the flow of fuel through the individual injector, giving the results of flow reduction as set forth above.

TABLE I

| | | (Percent Flow Reduction) | | | | | | | | |
|---|---|---|---|---|---|---|---|---|---|---|
| Example | Test Cycles | 1 | 2 | 3 | 4 | 5 | 6 | 7 | 8 | Average Flow Reduction |
| A | 185 | 13 | 10 | 6 | 22 | 8 | 6 | 17 | 8 | 11.3 |
| B | 176 | 4 | 3 | 3 | 13 | 9 | 1 | 12 | 21 | 8.8 |
| C | 175 | 10 | 2 | 7 | 10 | 14 | 8 | 6 | 43 | 12.5 |
| D | 175 | 10 | 21 | 9 | 1 | 0 | 17 | 19 | 27 | 13.0 |

EXAMPLE E

(Invention-Fuel Pressure Line Depressurized Upon Ignition Shut-off)

Table II shows the percent flow reduction when the system described above is modified so that the pressure regulator opens to relieve pressure in fuel pressure line 12 by permitting flow into fuel return line (16), promptly after ignition shut-off. The average flow reduction is only 3.0%, well within the tolerable range for maintaining drivability. Experience has shown that drivability can be maintained up to about 10% flow reduction in the individual port fuel injectors. Even more desirable, testing of the individual injectors shows reductions ranging one to about seven percent, all within acceptable limits of plugging.

TABLE II

| Example | Test Cycles | (Percent Flow Reduction) 1 | 2 | 3 | 4 | 5 | 6 | 7 | 8 | Average Flow Reduction |
|---|---|---|---|---|---|---|---|---|---|---|
| E | 175 | 1 | 1 | 5 | 7 | 2 | 4 | 2 | 2 | 3.0 |

MODIFICATIONS

It will be understood by those skilled in the art, that the invention is not to be limited by the above examples and discussions, in that the examples are susceptible to a wide number of modifications and variations without departure from the invention. For example, the volume of the fuel pressure line can be increased, e.g. by a bellows, to reduce pressure after ignition shutoff.

References to documents made in this specification is intended to expressly incorporate, herein by reference, such documents including any patents or other literature references cited within such documents.

What is claimed is:

1. A method for reducing the formation of fuel-derived deposits on close tolerance port fuel injector components, which comprises the steps of: (a) sensing shut-off of engine ignition regardless of fuel temperature; and (b) automatically reducing the fuel pressure at the inlet of said injector to a pressure less than about 10 kPa when shut-off is sensed.

2. A method according to claim 1, wherein the injector is located within about 8 centimeters (3 inches) of the combustion chamber of said engine and wherein said fuel line is automatically depressurized to a pressure less than about 5 kPa.

3. A method according to claim 1, wherein at least a portion of said components of said port fuel injector are subjected to temperatures in excess of 80° C. (176° F.) at some point during the period of shut-off of the engine on which said injectors are mounted.

4. The method according to claim 2, wherein the fuel pressure is reduced by bypassing a fuel pressure line regulator means, said bypassing being responsive to cut-off of ignition.

5. A method according to claim 2, wherein said fuel pressure is reduced by actuation of a valved shunt which vents pressure from said fuel pressure line, and wherein said valved shunt is actuated in response to cut-off of engine ignition.

6. A method according to claim 5, wherein said pressure from said fuel pressure line is vented to a fuel return line.

7. A method according to claim 4, wherein said pressure from said fuel pressure line is vented to the source of said fuel.

8. A method according to claim 1, wherein said fuel pressure at the inlet of said injector is automatically reduced in response to shut-off of engine ignition by actuation of a valve which vents said pressure from said fuel pressure line to the source of fuel for said engine.

9. A method according to claim 8, wherein said source of fuel comprises the fuel tank of a motor vehicle.

10. A method according to claim 9, wherein said fuel comprises gasoline.

* * * * *